United States Patent [19]

Joffe

[11] Patent Number: 4,991,836

[45] Date of Patent: Feb. 12, 1991

[54] DYNAMIC GAME APPARATUS AND METHOD USING MULTIPLE MAGNETS AND A MAGNETIC MANIPULATOR BELOW THEM

[76] Inventor: Benjamin Joffe, 22314 James Alan Cir., Chatsworth, Calif. 91311

[21] Appl. No.: 298,738

[22] Filed: Jan. 19, 1989

[51] Int. Cl.[5] ..... A63F 9/00

[52] U.S. Cl. ..... 273/1 GD; 273/239; 273/85 F; 446/131; 446/139

[58] Field of Search ..... 273/1 GD, 1 M, 238, 273/239, 126 A, 85 F; 446/131, 132, 133, 134, 135, 136, 137, 138, 139

[56] References Cited

U.S. PATENT DOCUMENTS

| | | | |
|---|---|---|---|
| 2,987,852 | 6/1961 | Koch | 446/139 |
| 3,680,865 | 8/1972 | Davis | 273/239 |
| 4,014,544 | 3/1977 | Kimura | 273/1 GD |
| 4,211,411 | 7/1980 | McDaniel et al. | 273/1 M |
| 4,293,133 | 10/1981 | Baron et al. | 446/131 |
| 4,331,333 | 5/1982 | Willcocks | 273/238 |
| 4,391,447 | 7/1983 | Dudley | 273/238 |

OTHER PUBLICATIONS

"Space Trix", 3/10/65.

*Primary Examiner*—Edward M. Coven

*Assistant Examiner*—Dean Small

*Attorney, Agent, or Firm*—Ashen Martin Seldon Lippman & Scillieri

[57] ABSTRACT

Several permanent magnets are on a playing surface, with all the magnetic field vectors perpendicular to the surface and oriented in common (pointing in the same direction) relative to the surface. A player positions a magnetic manipulator below the surface, and below a selected magnet on the surface, and controls the manipulator so that the selected magnet forms a predetermined array with at least one other magnet on the surface. The field of the manipulator interacts with those of the magnets on the surface to apply exclusively magnetic force or torque to the selected magnet or the other magnet on the surface, or both. The field vector of the manipulator may be oriented either (a) generally in common with those of magnets on the surface—to levitate the "other" magnet above the selected magnet by an interactive magnetic-wedge effect—or (b) generally parallel to that of the selected magnet, but in opposition, to repel the selected magnet above the other magnet. Magnetic-field sensors or mechanical-pressure sensors are mounted on the individual magnets, with visible or audible indicator devices, to announce various kinds of events related to progress of the game.

56 Claims, 12 Drawing Sheets

DYNAMIC GAME APPARATUS AND METHOD USING MULTIPLE MAGNETS AND A MAGNETIC MANIPULATOR BELOW THEM

BACKGROUND

1. Field of the Invention

This invention relates generally to game apparatus and method; and more particularly to game apparatus and method employing macroscopic permanent magnets on a playing surface and a magnetic manipulator that is disposed below the magnets and below the playing surface.

2. Prior Art

U.S. Pat. Nos. 2,987,852 and 2,940,216 to Koch, 3,883,988 to Fields, and 2,528,938 to Wolf appear to represent the state of the art in games that use permanent magnets in a playing region and magnetic manipulators that move the permanent magnets.

Koch '852 uses a manipulator that is positioned substantially at the playing surface—that is, laterally adjacent to the individual magnets on the surface. At least some of his individual magnets on the surface must carry flanges or skirts that allow one magnet to, in effect, trip over the edge of a second and thereby flip over onto the top of the second. This effect is obtained as follows.

In Koch '852 the flange or skirt is well below the center of gravity of the attached magnet. Thus when the first, flanged magnet and a second magnet are brought forcibly together the flange stops the bottoms of the two magnets from moving together—but the centers of gravity of the two magnets tend to continue moving together.

The result is relative rotation of one or both magnets about the edge of the flange. In short, Koch uses the force developed between the manipulator and one of the permanent magnets as a means of generating *mechanical* torque, which catapults one of the magnets onto the other. This effect may be entertaining, but it requires relatively cumbersome attachments to at least some of the magnets; and as will be seen it is relatively primitive.

Koch '216 too uses a manipulator that is positioned at the playing-surface level—laterally adjacent to the independent magnets on the surface—and merely exploits the force between the manipulator and the independent magnets to develop torque mechanically.

Here the independent magnets are made with a convex bottom section, and the manipulator is held with its field vector at a slight angle to that of one of the independent magnets. Upon repulsion by the adjacent manipulator, the independent magnet rocks away from the manipulator in a direction determined by the angle between the field vectors—and is thereby induced to spin about, roughly, its own axis. Like the '852 patent, its principle is thus a relatively primitive mechanical effect.

The patent of Wolf even more simply uses ordinary linear repulsion between a bar-magnet manipulator and bar magnets mounted horizontally on wheeled figurines to move the figurines in play on a board. Thus for example the figurines may be made to represent miniature football players on a miniature football field, and through proximity of the manipulator the figurines are driven on the "field" in a simulated miniature game of football.

The Fields patent is of a different sort. It uses a large multiplicity of miniature or nearly microscopic permanent magnets. These may be small pieces of magnetic recording tape, or small magnetic ring-core memory elements, or the like—constrained in a shallow box by a transparent cover. When a bar magnet is held near, these multiple tiny magnets jump from place to place and form patterns that may be visually entertaining. The patterns are enhanced by making the individual magnets, or different facets of individual magnets, different colors.

The individual magnetic pieces are typically under 0.1 inch square and a few thousandths of an inch thick, when pieces of recording tape are used; or even much smaller (under 0.02 inch diameter by 0.004 inch height) when ring cores are used. In either event, several hundred such particles are placed into the box, and as will be apparent they are treated essentially as a group that forms a *medium*, rather than as individual macroscopic articles.

Other patents such as U.S. Pat. Nos. 3,940,135 to Cohen, 3,033,573 to Castle, or 417,931 to Miatt are of less interest. They use merely passive metallic pieces that are attracted by a magnet and thereby moved about in a playing region.

SUMMARY OF THE DISCLOSURE

My invention provides game apparatus, and method for playing a game. I shall discuss the apparatus first.

The game apparatus of my invention is for use by a player (or of course a group of players if preferred), and includes a base that defines a playing surface. The apparatus also includes macroscopic permanent magnets supported directly on the playing surface.

By "macroscopic" I mean having a size typical of playing pieces such as checkers—or perhaps a third or a quarter of that size, at the least—and thus of an entirely different order from the miniature or nearly microscopic magnetic flakes or rings of U.S. Pat. No. 3,883,988, mentioned earlier.

Each macroscopic permanent magnet has a magnetic field vector that is substantially perpendicular to the surface where that magnet is supported. In addition, the magnets have their respective field vectors oriented in common relative to the surface where, respectively, the magnets are supported.

The two conditions stated in the preceding paragraph are both recited in relation to the surface at the point where each magnet is supported. The conditions are couched in this way because the playing surface need not necessarily be planar.

If it is planar, the field vectors are all substantially parallel *mutually*—that is to say, parallel to each other. They also are oriented in common (in other words, all pointing in the same direction) mutually—that is, oriented in common relative to each other.

If the surface is nonplanar, however, then depending upon the locations of the respective magnets at any particular instant the vectors may not necessarily be parallel mutually, or oriented in common mutually. It is to be understood that the playing surface may be configured very elaborately—e.g., in complex three-dimensional shapes that include apertures or other special features. The conditions are nevertheless satisfied as recited in relation to the surface.

The game apparatus also includes a magnetic manipulator that is disposed below the playing surface, and generally below a first particular individual one of the magnets, and is controlled by a player of the game.

More specifically, the magnetic manipulator is generally below a first particular magnet considered individually, rather than only as part of a large multiplicity of tiny pieces. Further, the manipulator is controlled to cause the first particular one magnet individually to form a predetermined regular array with at least one other particular individual one of the magnets.

The foregoing may be a description of my invention in its broadest or most-general form. To maximize the enjoyment and entertainment provided, however, I prefer to practice the invention with certain other characteristics or features.

For example, I prefer that the game apparatus be configured so that the magnetic field of the manipulator interacts with the magnetic fields of the magnets to apply exclusively magnetic force or torque, or both, to either or both of the two magnets mentioned above—that is to say, either to the first particular individual one magnet, or to the other particular individual one magnet, or to both.

By the phrase "exclusively magnetic" I mean to exclude force or torque that is derived partly by attaching to the individual magnets a mechanical element that modifies or conditions the magnetic effect, as in the Koch patents. As will be seen, there are various ways in which exclusively magnetic force or torque can be applied to the two individual magnets.

These different ways of applying exclusively magnetic force or torque make possible various alternative preferred forms of the invention. I shall now take up two of these forms in turn.

In a first preferred form of my invention, I prefer that the magnetic field vector of the manipulator be oriented substantially in common with the magnetic field vector of the permanent magnets. In this form of my invention, as will be appreciated, solely *attractive* magnetic force is applied to *both* magnets.

Yet, by virtue of the principles of magnetism as employed in this particular form of my invention, the manipulator levitates the previously mentioned "other" magnet above the "first" magnet. In practicing this particular form of the invention, I prefer that the magnetic field of the manipulator be oriented at an angle to the magnetic field vector of the first magnet, and that it interact with magnetic field vectors of the first and other magnets.

In this mode of operation, angles as high as fifty degrees are desirable. These conditions develop a magnetic-wedge effect that raises a nearer edge of the other magnet so that it can slide upward onto the first magnet.

In a second preferred form of my invention, I prefer that the magnetic field vector of the manipulator be oriented generally parallel to the magnetic field vector of the first particular individual one magnet, but substantially in opposition. In other words, the magnetic-field vector of the manipulator points generally in the opposite direction to the magnetic field vectors of that magnet and in fact the several permanent magnets on the playing surface, and *repels* the first magnet above the other magnet to form the array.

I also prefer that my invention include a multiplicity of the macroscopic permanent magnets, and that the array created during play of the game include this multiplicity of magnets. In this preferred form of the invention, the array inherently possesses a definite predetermined geometric relationship between all of the magnets in the array—a relationship that is defined, for purposes of the game, as "correct".

For example, in one preferred form of the invention the individual magnets are all distinctly different from one another in configuration; and the "correct" relationship is defined at least partly in terms of distinct differences in configuration. In another preferred form, the individual magnets bear distinctly different indicia; and the "correct" relationship is defined at least partly in terms of distinct differences among the indicia.

In yet another form, the individual magnets include means (either configuration or indicia, or both) for rendering distinctive their rotational orientation about a vertical axis; and the "correct" relationship is defined in terms of relationships between rotational orientations of the magnets in the array.

I also prefer that the apparatus of my invention include, mounted to each one of at least some of the permanent magnets, an associated sensor and indicator for indicating events related to the progress of the game. The sensor may be made responsive to the magnitude of magnetic-induction field, or to pressure between the host magnet and the playing surface or other magnets, or to velocity or acceleration of the magnets, or to combinations of these or other parameters.

The indicator produces an indication that is, for example, visible or audible; or that is in the form of a broadcast radio beam, acoustic beam, or light beam which actuates an audible or visible mechanism elsewhere in the apparatus—e.g., under, above or beside the playing surface, or in other magnets. The sensor and indicator may be powered by a battery or electrooptical device also mounted to the associated magnet.

As mentioned earlier, my invention also provides a method for playing a game. In this connection the invention includes the following steps, in the order presented.

(1) positioning macroscopic permanent magnets directly on a playing surface:

In this step the magnets are positioned with the magnetic-field vector of each magnet substantially perpendicular to the surface where that magnet is positioned. In addition, the respective field vectors are directed in common relative to the surface where, respectively, the magnets are positioned.

(2) disposing a magnetic manipulator below the surface, and generally below a first particular individual one of the magnets (3) controlling the manipulator to cause the first particular one magnet individually to form a predetermined regular array with at least one other particular individual one of the magnets.

This recitation of three steps may represent the method of my invention in its broadest or most general form; however, here too, I prefer to practice the invention with various characteristics or features that enhance its effectiveness. All of these refinements will be discussed in detail below.

It may be mentioned here, however, that they include additional steps related to prearranging the permanent magnets in an initial pattern on the playing surface—which prearrangement may, for example, impose a particular corresponding level of difficulty upon the subsequent repetitive controlling steps required to form the array. The additional preferred steps may also, or instead, be related to assigning a game score, or determining a winning player.

All such added steps provide a particularly sophisticated interaction of the novel physical context of my invention with the strategic abilities and competitive urges of the players. Hence my invention fully exploits the psychology as well as the physics of gaming, to provide a game with unusually long-lasting interest for the players.

Based upon the summary presented above, it will now be understood that my invention provides game apparatus and method that are much more interesting and attention-holding than earlier games. My invention has these advantages for at least three separate reasons:

First, it makes possible the use of magnetically developed force and torque in ways that are not seen in other contexts. In other words, my invention involves physical forces and motions which people generally find surprising or almost mystifying.

Second, my invention proceeds by physical processes that are much more rapid and abrupt than those of prior games. In other words, it is a much more dynamic game.

These first two advantages are derived rather directly from a novel application of physical principles to the field of games. Third, as will be seen, my invention goes beyond these advantages to exploit, in a very sophisticated way, the psychological or human-nature aspects of the novel game context.

All of the foregoing operational principles and advantages of my invention will be more fully appreciated upon consideration of the following detailed description, with reference to the appended drawings, of which:

DETAILED DESCRIPTION OF THE PREFERRED EMBODIMENTS

Figure 1:
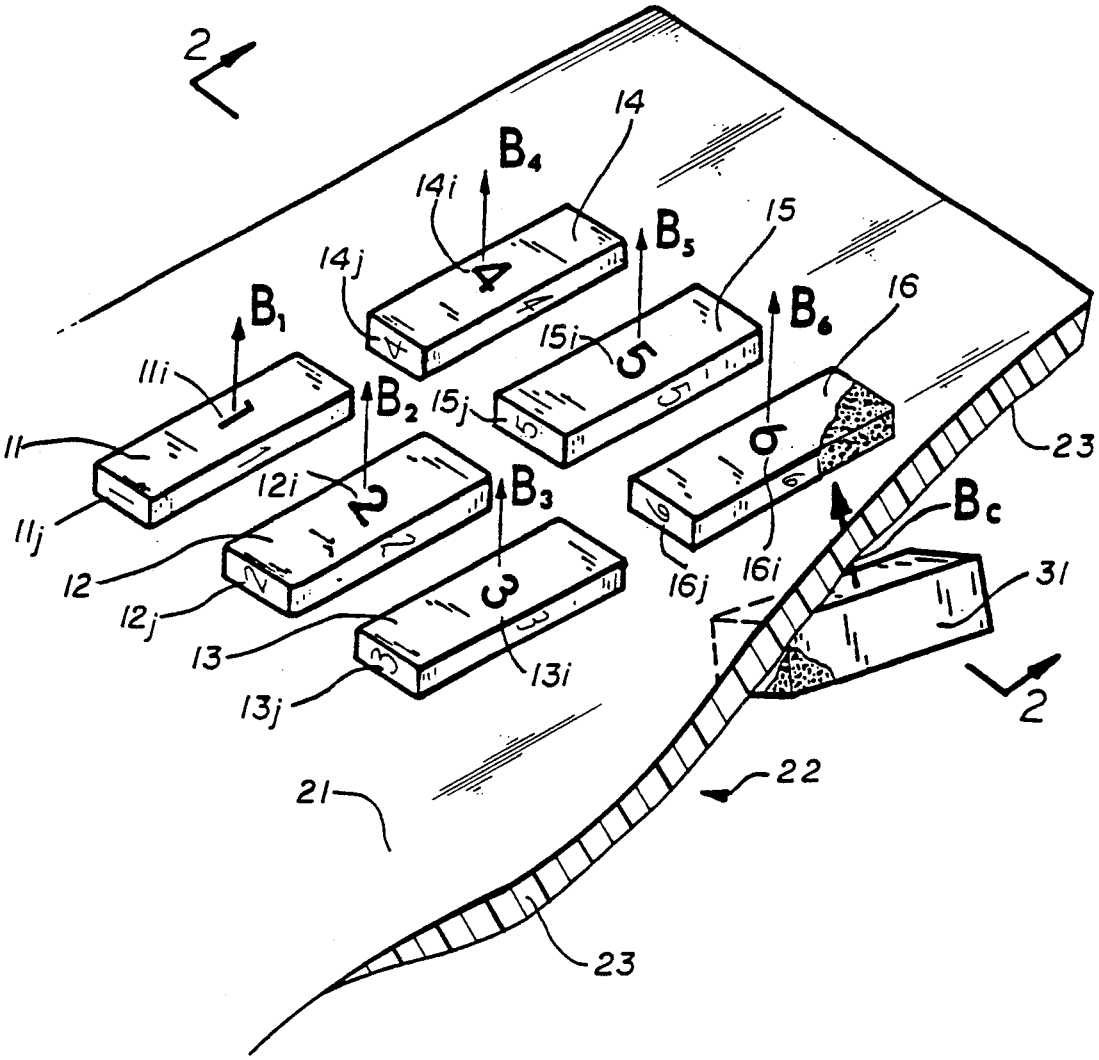
FIG. 1 is a perspective view of one preferred form of the game apparatus of my invention, with the playing surface partly cut away to better show the manipulator below the surface. This drawing represents the apparatus in the first of the forms of the invention discussed earlier, and at a preliminary point in the progress of the game.

As shown in FIGS. 1 through 5, my invention provides a plurality of individual macroscopic permanent magnets 11 through 16, disposed on a playing surface 21, and a magnetic manipulator 31 below the playing surface. The playing surface 21 is typically the upper surface of a board or panel 22. In FIG. 1 the board 22 is drawn cut away at 23 to better show the manipulator 31 below the board.

The magnets 11–16 advantageously carry respective identifying indicia **11*i*–16*i* on their top surfaces, and additional respective identifying indicia 11*j*–16*j*** on their end surfaces. These indicia are used for distinguishing the magnets from one another during play, and may as shown simply take the form of numerals, e.g., "1" through "6"; as will be apparent, other forms of indicia may be used as preferred.

The magnets 11–16, and the manipulator 31, have respective magnetic fields, which as is well known describe toroidal loci, as suggested in FIGS. 2 through 5. The magnetic-field vectors $B_1$ through $B_6$, and $B_c$, at the centers of the toroidal patterns generally pass perpendicularly through the centers of the respective magnets—and for the sake of simplicity and definiteness this arrangement is assumed in the drawings, and in this text and the appended claims.

In particular, throughout the appended claims and most of the text of this document, references to the "magnetic field vectors" of the magnets are intended to refer to these concentrated central magnetic fields $B_1$–$B_6$ and $B_c$, as clearly shown in FIG. 1. The magnets 11–16 and 31 are formed and magnetized—in one customary fashion for relatively flat magnets—so that the vectors are perpendicular to the lateral extents of the respective individual magnets, also as indicated in the drawings. As will be understood, however, pieces of magnetic material can be shaped in other ways, both regularly and irregularly, relative to the magnetic-field vectors; and the appended claims are meant to cover such variant configurations as well.

FIG. 1 shows the individual permanent magnets 11–16 disposed on the playing surface 21 in a fashion which is relatively amenable to their rearrangement into an array. As will be seen, however, this disposition of the magnets on the surface is not necessarily their arrangement on the surface at the *start* of play.

Figure 2:
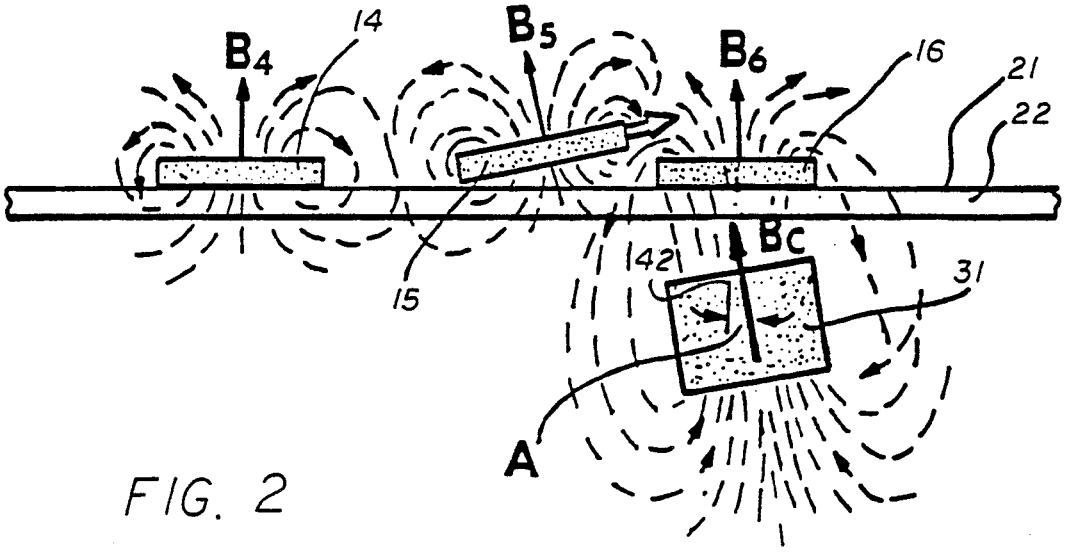
FIG. 2 is an elevational view of the FIG. 1 form of the invention, at the same time, taken in section along the line 2—2 of FIG. 1.
Figure 3:
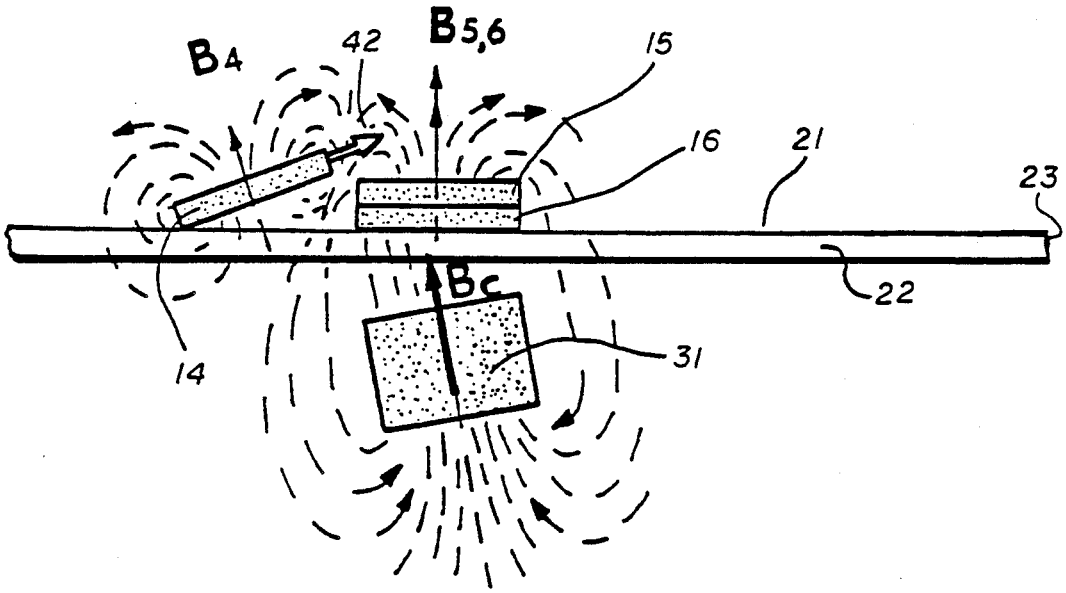
FIG. 3 is a similar view of the same form, showing the same apparatus at a later time in the progress of the game.

FIGS. 1 and 2 show the individual magnets 11–16 and the manipulator 31 positioned for their use in the first form of the invention described earlier. As can be seen, the manipulator 31 is generally below a first particular magnet 16, and its magnetic-field vector $B_c$ is at an angle A (FIG. 2) to the vector $B_6$ of that first particular magnet 16.

The magnetic-field vectors $B_c$ and $B_1$ through $B_6$ of the manipulator and the individual magnets on the playing surface 21 are all oriented in common. Therefore the magnetic force between the manipulator 31 and each of the individual magnets 11–16 is attractive; the force between any two of the individual magnets 11–16 on the surface, however, is repulsive.

Hence the manipulator 31 attracts magnet 16, and also attracts magnet 15, etc. Since the manipulator is relatively quite close to magnet 16, the strongest influence of the manipulator is on that magnet, and its effect on that magnet is to draw it downward strongly against the playing surface 21, and in effect lock it forcibly in place to the surface.

The magnet next-most-strongly influenced by the manipulator 31 is the next-nearest or "other" magnet 15. The force on this magnet is regulated by the angle A of the manipulator magnetic-field vector $B_c$ from the vertical—or, more strictly speaking, from the magnetic-field vectors $B_6$ and $B_5$ of the two magnets 15 and 16 on the playing surface.

Rotating the manipulator 31 to increase this angle A displaces the region of greatest strength in the magnetic-field pattern of the manipulator, and also changes the orientation of that field pattern. These effects tend to strengthen the force exerted by the manipulator 31 upon the adjacent "other" magnet 15, and also to make the *lateral* component of that force greater.

Consequently the manipulator 31 draws the adjacent "other" magnet 15 laterally or sideways toward the "first" magnet 16 that is more directly above the manipulator. Since these two magnets 15 and 16 strongly repel each other, however, resistance develops to their mutual approach. That is, the repulsive force between the two magnets resists the attractive force between the adjacent magnet 15 and the manipulator 31.

Since the nearer or "first" magnet 16 is essentially locked in place on the board, the net effect of the repulsion is exerted almost entirely upon the adjacent magnet 15. That adjacent magnet moves in such a direction as to minimize the forces upon it, and that direction is upward and to the right, along the arrow 41 in FIG. 2. In other words, the nearer edge of the adjacent magnet 15 rides upward and rightward (as drawn in FIG. 2), *over* the repulsion field developed between the two magnets 15 and 16 on the playing surface.

As soon as the adjacent magnet 15 begins to pass over the edge of the nearer magnet 16, the repulsion between the two magnets abruptly begins to be neutralized. The relationship between the magnetic fields of two such magnets when one is *directly* above the other creates a strong attraction between them.

In a transition zone, with the adjacent magnet 15 beginning to pass over the edge of the nearer magnet 16, as the adjacent magnet progresses the repulsion first weakens and then gives way to attraction. If the manipulator 31 is operated in such a way as to start this series of motions, the two magnets above the surface tend to complete the motion themselves—and the adjacent magnet 15 in essence stacks itself upon the nearer magnet 16.

As will be appreciated, however, a certain amount of skill can be developed in making this completion of the stacking reliable and neat. If the magnets are left to complete the motions from their positions shown in FIG. 2, the two individual magnets on top of the board may clamp to each other magnetically before they are properly aligned.

Some added relative lateral movement of both magnets 15, 16 can be imparted by the player's good manual technique in operating the manipulator. Thus an object of play is to not only start the motion into the position illustrated, but then continue it to provide a neatly stacked array.

One way to produce this result is to move the manipulator quickly to the left while the other magnet 15 is airborne, to slide the nearer magnet 16 leftward along the surface 21 and effectively wedge the nearer magnet 16 under the other magnet 15. With such a technique, the adjacent magnet tends to center itself over the nearer magnet 16 before joining tightly together with it.

Once an array of two magnets 15, 16 has been created, the manipulator 31 can be used to move that array 15/16 as a unit. In this way the array 15/16 can be positioned near yet another independent magnet 14.

The manipulator 31 can then be used, in generally the same fashion already described, to levitate this other independent magnet 14, along the path shown by the arrow 42 (FIG. 3), toward the top of the array 15/16. Once again the array 15/16 can be made to slide leftward at the correct time to position the additional magnet 14 neatly in the augmented array.

Figure 4:
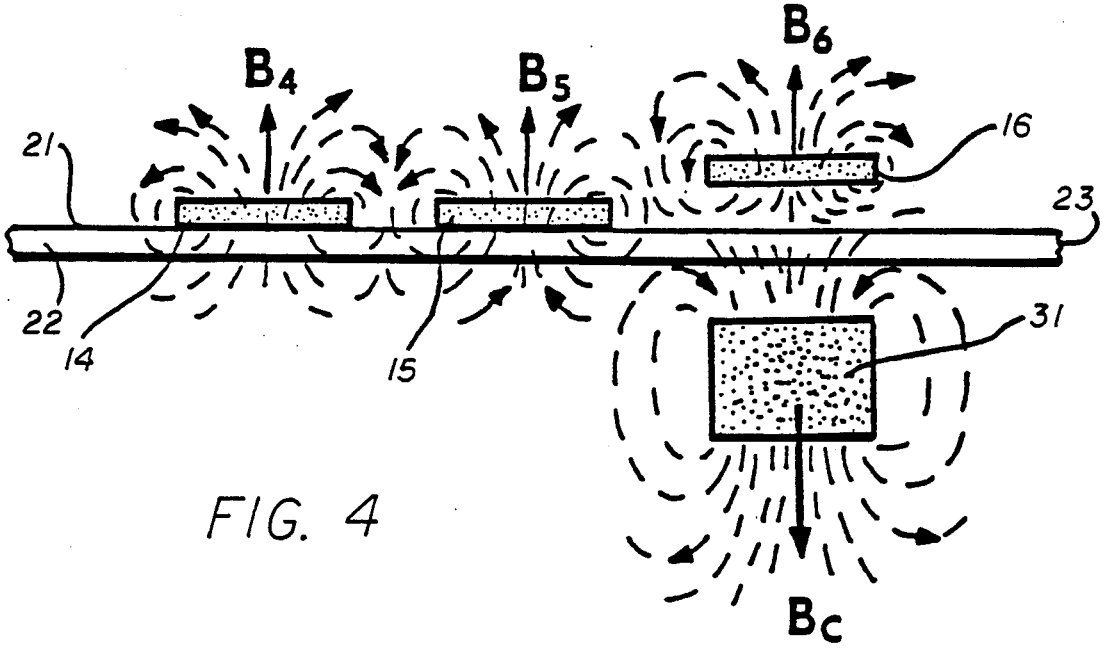
FIG. 4 is a similar elevational section of the second preferred form of the invention, also discussed earlier.

FIG. 4 shows the second form of the invention. Here the magnetic-field vector $B_c$ of the manipulator 31 is oriented oppositely to those $B_4$–$B_6$ of the independent magnets 14–16, and lifts them from the playing surface 21 by repulsion.

While this form of levitation may be somewhat more familiar, it is nevertheless far from trivial to use. Simply holding one independent magnet 16 above the surface 21, by use of the manipulator 31, can require some dexterity—for the upper magnet is generally in metastable equilibrium, at best, above the manipulator.

Furthermore, simply raising the independent magnet 16 vertically from the playing surface 21 does not suffice to stack it in an array with an adjacent magnet 15. Lateral motion too is required. Different techniques can be used to form an array.

For example, the first magnet 16—the one that is to be placed on top—can first be moved away at some distance from the other magnet 15, and then the first magnet 16 can be moved quickly toward the other 15 while the first magnet is already above the surface 21, or as it is progressively raised above the surface.

The first (upper) magnet 16 may also be tilted slightly upward on the edge nearer the other magnet 15. In this way the upper magnet 16 effectively planes or sails up along the repulsive force field between it and the lower magnet 15.

Figure 5:
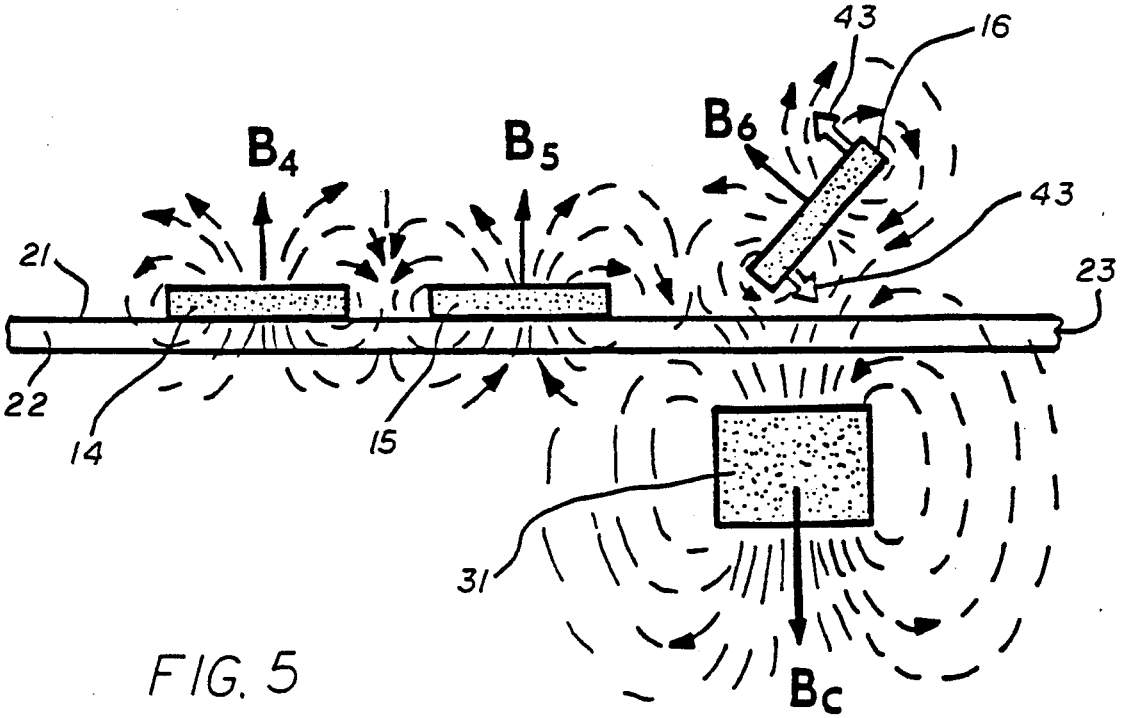
FIG. 5 is a like view of the FIG. 4 form of the invention, showing a variant manner of practicing that form of the invention.

FIG. 5 illustrates another technique for forming an array. Here the magnet 16 being lifted is kept relatively close to the surface 21—and possibly tilted downward on the edge nearer the other magnet 15—so that it cannot slide over the edge of the force field. It can be said to "stub its toe" on the force field itself, without the intermediary of a mechanical flange or skirt.

Abrupt motion of the manipulator upward and to the left then causes the lifted magnet 16 to somersault onto the top of the adjacent magnet, as suggested by the two arrows 43 (FIG. 5). Such a motion requires a *complete* somersault, since the moving magnet 16 cannot form a stable array with the stationary magnet 15 while their magnetic vectors $B_6$, $B_5$ are opposed.

Figure 6:
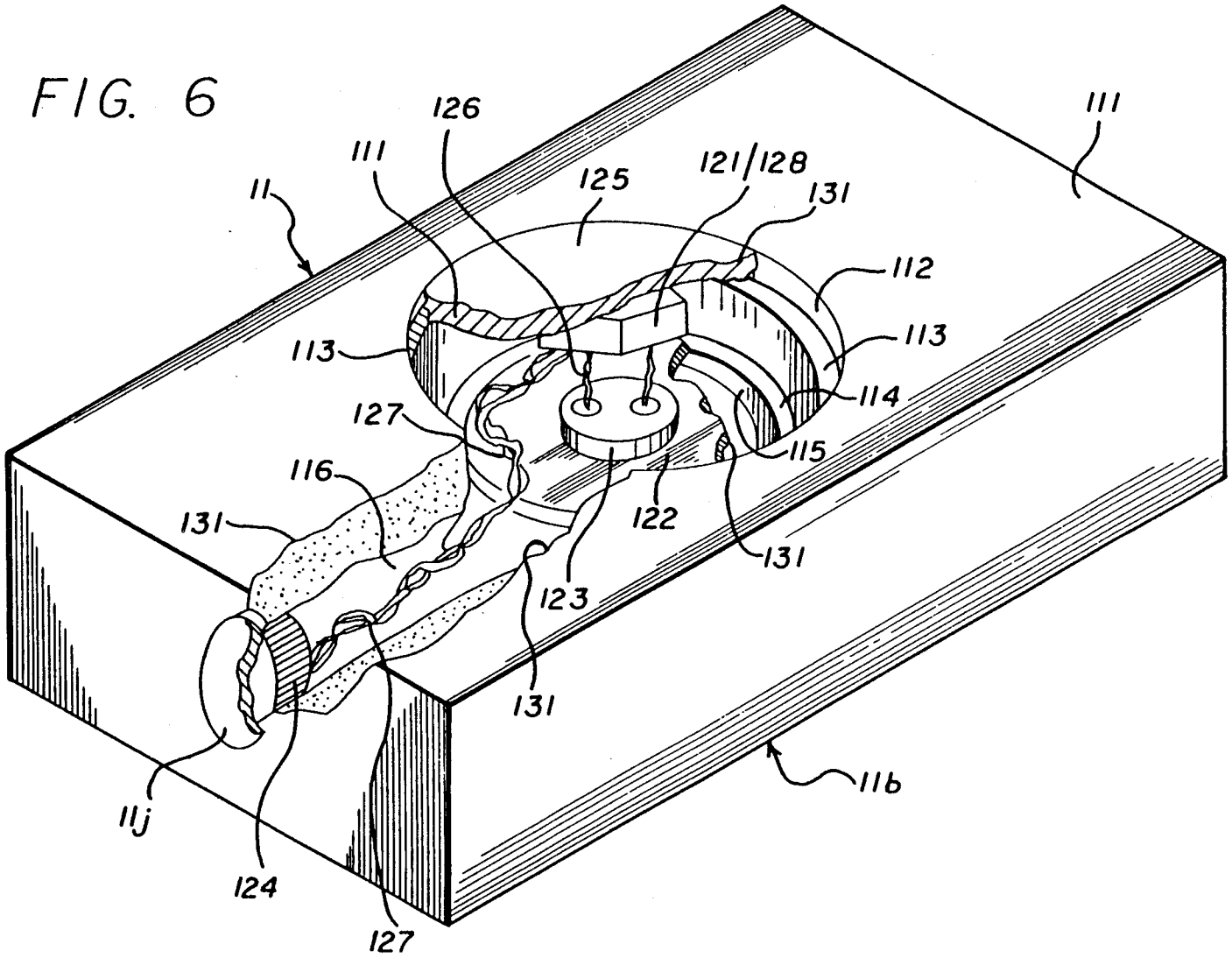
FIG. 6 is a perspective view, partially cut away, showing one of the permanent magnets with sensors, indicators and a controller or processor installed.
Figure 7:
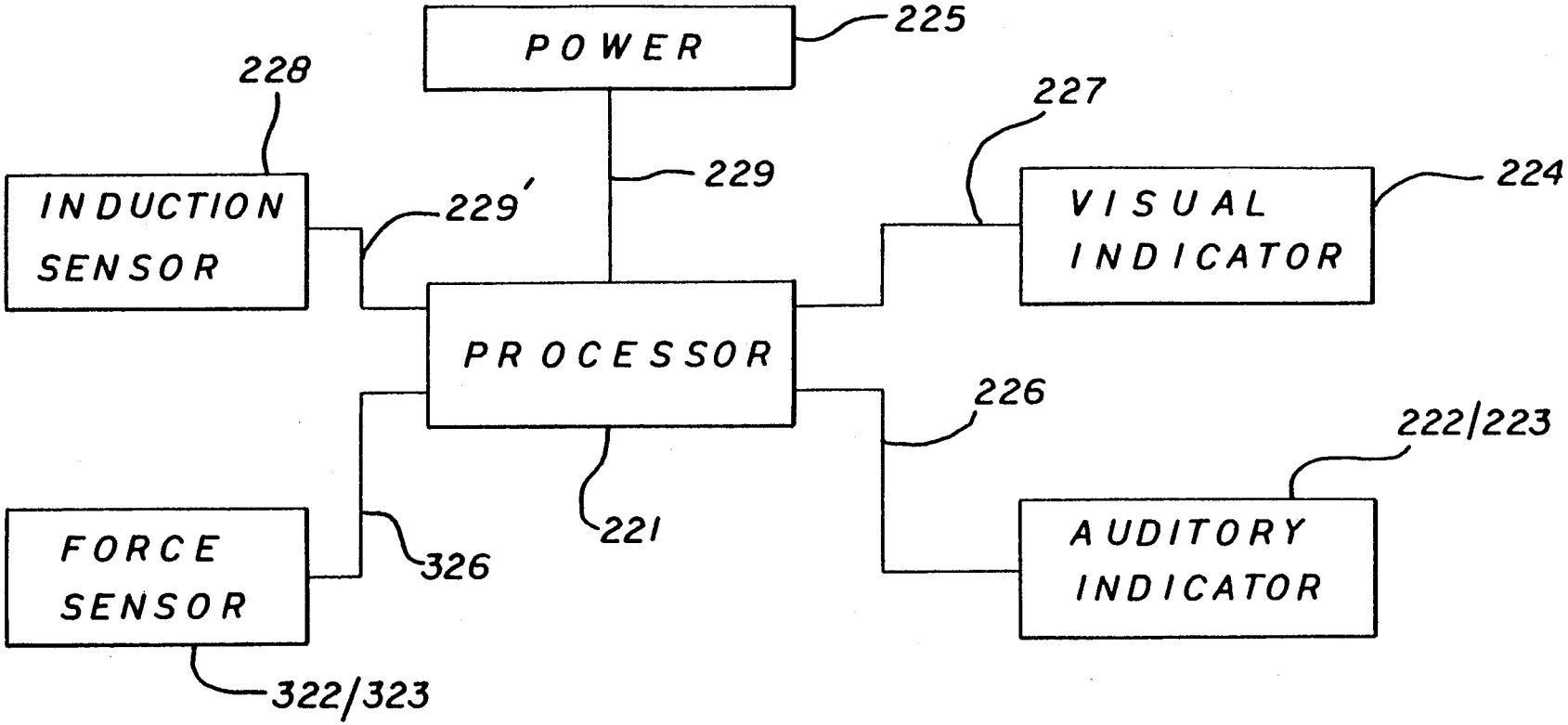
FIG. 7 is a generalized electronic block diagram of the components installed in the FIG. 6 magnet.

A refinement of the game apparatus of my invention appears in FIGS. 6 and 7. As shown in FIG. 6, a typical individual magnet 11 is fitted internally with devices for sensing and indicating events related to progress of the game.

More specifically, a vertical cylindrical hole 111–115 is formed through the magnet 11. This hole is smallest in diameter at its lowermost segment 115, which thus forms an internal flange 114–115 just above the bottom of the through-hole—and just above the bottom surface 11*b* of the magnet 11.

The upper surface 114 of this flange 114–115 serves as a ledge for support of a thin disc 122. The disc 122 and several other components, to be discussed below, are drawn broken away at 131 to provide clearer views of the components below or behind. The disc 122 is cemented or otherwise fixed in place about its periphery, and in turn supports a firmly secured piezoelectric crystal or element 123.

The hole 111–115 is largest in diameter at its uppermost segment 112, which thus forms another ledge 113 just below the top surface 11*t* of the magnet 11. Cemented or otherwise secured in place on this ledge, and within the uppermost segment 112 of the hole, is a disc-shaped solar cell or battery 125.

Fixed to the underside of this power source 125, and functionally interconnected with it, is a controller or processor 121. The processor includes an integral magnetic-induction-field sensor 128, which receives power from the source 125 through the processor 121.

A usable two-state magnetic-field sensor 128 can be provided in the form of a magnetized needle or vane, similar to a compass needle, disposed to complete an electrical circuit when in certain positions. I prefer, however, to use a magnetically-sensitive transistor or like device for the magnetic-field sensor 128; such a device can at least in principle be fabricated integrally with the processor 128.

A side-tunnel or conduit 116 is formed through at least one end of the magnet 11, communicating with the central vertical through-hole 111–115. The side-tunnel 116 terminates just behind an indicium 11*j* of the sort previously discussed—which here may be of translucent plastic, cemented or otherwise fixed over the end of the tunnel. Fitted within the end of the tunnel 116 is a light-emitting diode (LED) or other electrically controlled light source 124.

Electrical leads 126 and 127 functionally interconnect the processor 121 with, respectively, the piezoelement 123 and LED 124. In practice the piezoelement 123 can serve in a familiar fashion in either of two ways.

In particular, the piezeolement 123 can receive electrical impulses from the processor 121 and correspondingly drive the disc 122, which thereby functions as an audio speaker. If preferred, however, the piezoelement 123 can instead provide electrical impulses to the processor 121 in response to mechanical force or pressure applied to the disc 122, which thereby functions as a mechanical force sensor.

In the latter case, as will be understood, the disc may be provided with a central pedestal or protrusion that extends outward (downward, as drawn in FIG. 6) to intercept mechanical force applied at the bottom surface 11*b* of the magnet 11. In the former case the disc may be better left free to vibrate in response to the driver 123; however, those skilled in the field of piezo and like drivers may be able to mount and configure a single disc 122 so that it can serve both functions concurrently.

FIG. 7 is an electronic block diagram, showing the functional blocks that correspond to the various physical components of FIG. 6. Components of FIG. 6 having a prefix "1" in their callout numerals (e.g., power element 125 of FIG. 6) correspond very generally to functional blocks in FIG. 7 having the same final digits, but with a prefix "2" or "3" (e.g., power element 225 in FIG. 7).

Thus FIG. 7 shows that the processor 221 receives power from a solar cell, battery or other power source 225—preferably portable and self-contained—along power path 229. The processor 221 also receives from the induction sensor 228, along electrical signal path 229', electrical signals related to the overall strength of the magnetic induction at the position of the sensor 228.

In other words, the signals received by the processor 221 depend upon the strength of the magnetic field within the cavity 111/122/125 (FIG. 6) formed inside the magnet 11 by the cylindrical wall 111, the bottom disc 122 and the top power unit 125.

FIG. 7 also shows that the processor 221 drives an LED or other visual indicator (e.g., liquid-crystal display) 224, by electrical power applied along a path 227. Finally, a mechanical auditory indicator 222/223 or a mechanical force sensor 322/323—or both, as shown in FIG. 7—respectively receive electrical power along a driving-signal path 226 from the processor 221, or transmit electrical signals along a sensor-signal path 326 to the processor 221.

Now during play of the game, when more than one magnet is stacked together in an array 11–16 (FIG. 8), the commonly aligned magnetic fields add. Consequently a magnetic-field sensor 128, 228 suitably placed on or in any of the magnets in the array can be made to detect the existence of the array, or even—at least in the absence of nearby perturbing magnets—to detect how many magnets are present in the array.

Conversely, when magnets with commonly aligned fields are disposed on the playing surface 21 but near each other, the fields tend to subtract from one another slightly. A magnetic-field sensor 128, 228 accordingly can detect the occurrence of such an adjacency condition.

Mechanical pressure or force sensors 122/123, 322/323 can also be used to detect various conditions related to game play. For example, they can sense when a particular magnet is held down tightly against the playing surface or against another magnet below it, or is levitated out of contact with the surface. Similarly, if differently located at the top of the magnet, the force sensor can sense when a particular magnet has another article pressed firmly down on it from above.

All these conditions, particularly when occurring in combination, can be identified with various events arising in the play of the game. To add yet further visual and auditory excitement to an already dynamic game, these sensors 228, 322/323 can be made to actuate the indicator devices 222/223, 224 also carried on the magnets.

Accordingly I prefer to provide a processor 221 that responds to the signals from the sensors and appropriately directs power to the indicators, to develop auditory or visual indications of such events for enhancement of the interest and enjoyment of the players. A great variety of different types of processor 221, or of different control schemes for any particular processor, can be provdied to perform these functions in a vast variety of different ways.

For example, at its simplest the processor can simply respond to the sensors by causing the indicators to emit tones or light whenever the sensors report an elevated magnetic field or mechanical pressure, within preestablished ranges. In this simple case the processor is really only a straightforward controller, which may include the capability of selecting different tone frequencies—or of flashing the light in different ways—in dependence upon the particular range of magnetic field or mechanical pressure reported.

On the other hand, the processor can be made to respond to the sensor signals only if, for example, they occur in particular combinations, or only if they arise in specified time intervals or with particular timing interrelationships. The processor can be endowed with memory and interpretive capability adequate for a great variety of entertaining variations in signalling the progress of the game.

At this level the processor is much more than a controller and may best be termed a microprocessor. Its operation requires suitable programming, in a manner familiar to those skilled in the art of providing software or firmware for such devices.

Figure 18:
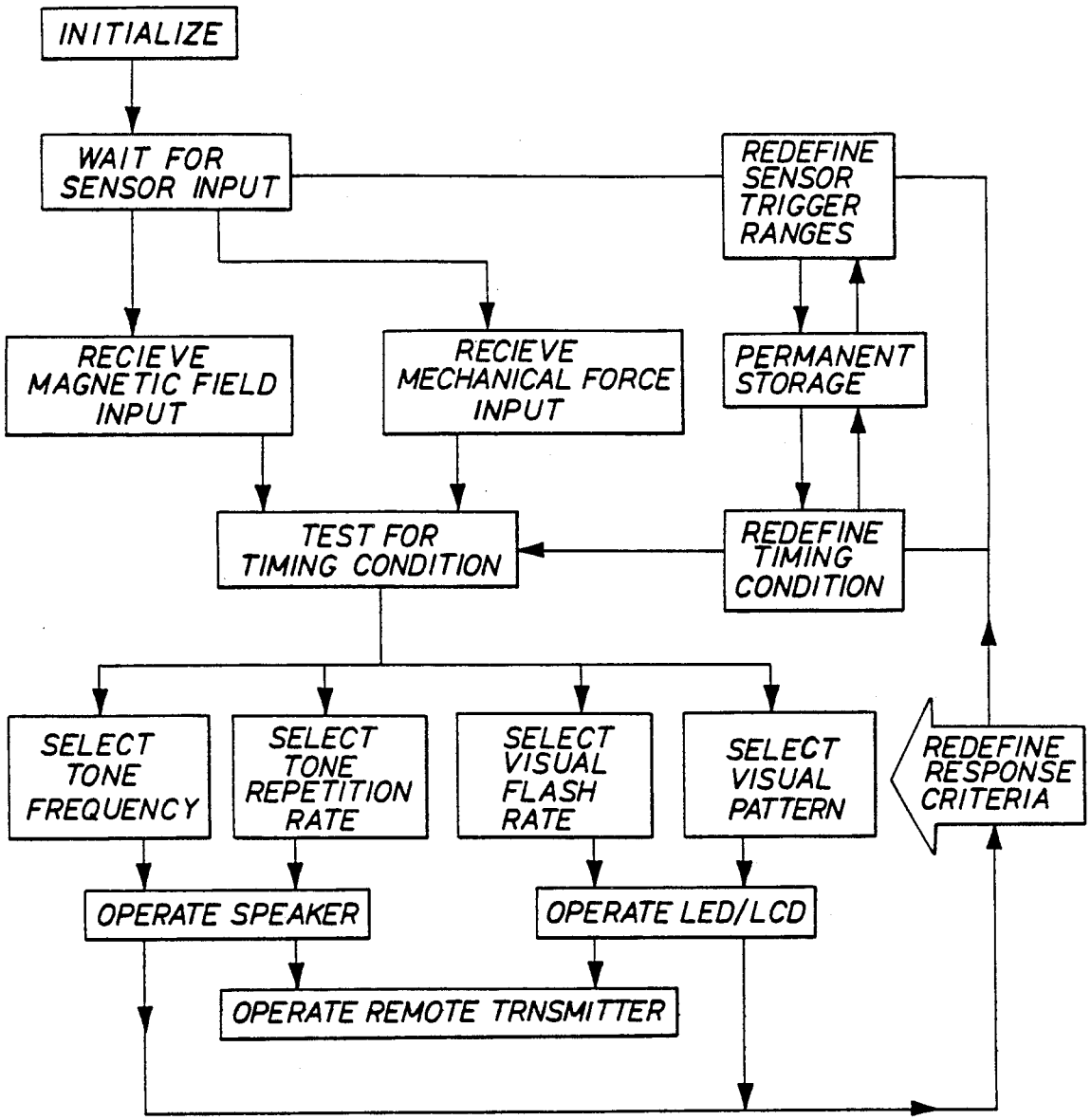
FIG. 18 is a flow chart showing one exemplary program scheme for use in the processor of FIGS. 6 and 7.

For example, as shown in the flow chart of FIG. 18 the processor in each magnet can be programmed to perform heuristic operations at several levels that cause the behavior of the indicator mechanisms to progressively evolve. As suggested in FIG. 18, through provision of permanent memory this evolution may mirror not only the progress of the game, but also the player' longterm development of manual and strategic skills.

Based upon this flow chart and the discussions in this text, persons skilled in the respective arts of electronic design and programming will be able to implement the sensor-and-indicator features of my invention in a straightforward fashion, but at a high level of sophistication.

With such a system the behavior of the indicator mechanisms can be made regular and consistent enough to reflect comprehensibly the progress of the game. At the same time it can be variable enough to impart a degree of independent pseudopersonality to each magnet, and thereby a great deal of added interest to the game.

As further indicated near the bottom of FIG. 18, under selected circumstances the software may also actuate a remote transmitter associated with the processor in each magnet. The transmitter may be a radio transmitter—or more modestly for example a separate operating mode of the speaker that generates a supersonic tone—but in any event the transmitter sends a signal to a receiving device that is preferably mounted in the playing surface or in one or more of the other magnets.

The receiving device may in turn actuate still other indicating devices, and advantageously perform some scoring functions. Scoring for my invention will be discussed shortly.

Playing the game of my invention as already described up to this point can be not only entertaining but also very challenging and competitive. Control of the manipulator requires good dexterity, reflexes and timing; and when there is more than one player ample opportunity arises for comparison of skill levels.

In addition, the game is intrinsically very dynamic and fast moving. These thrilling aspects of the game are enhanced and augmented by the sensor-and-indicator systems just described.

The appeal of my game, however, goes beyond the mechanical challenges, dexterity and excitement described so far. Once a player has learned the basic skills required to move the pieces (i.e., the magnets on the playing surface), so that they can be made to jump onto one another to form arrays, an additional overlay of skill is introduced by a requirement that the pieces by arrayed *correctly.*

Figure 8:
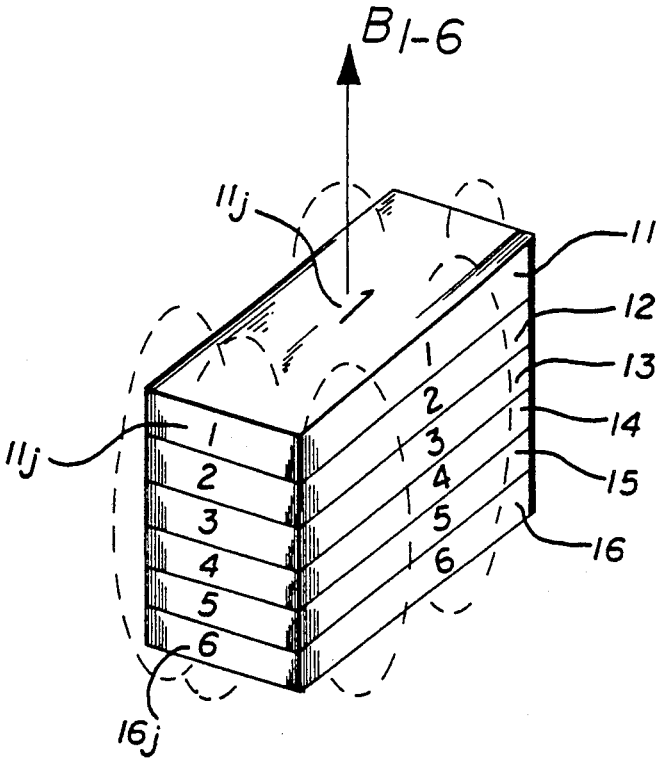
FIG. 8 is a perspective view showing one configuration of the permanent magnets of the invention, in an array.

Various features can be used to render the pieces distinct from one another, or to render several possible orientations of a single piece distinct from one another, so that particular combinations of pieces or orientations, or both, can be used to define correct arrays. For example, as already suggested, the individual magnets can carry indicia **11*i*–16*i* (FIG. 1), and/or 11*j*–16*j* (FIGS. 1 and 8). The latter indicia 11*j*–16*j*** are all visible after an array is formed, and so can be used to determine the extent to which the array is "correct" under game rules.

Figure 9:
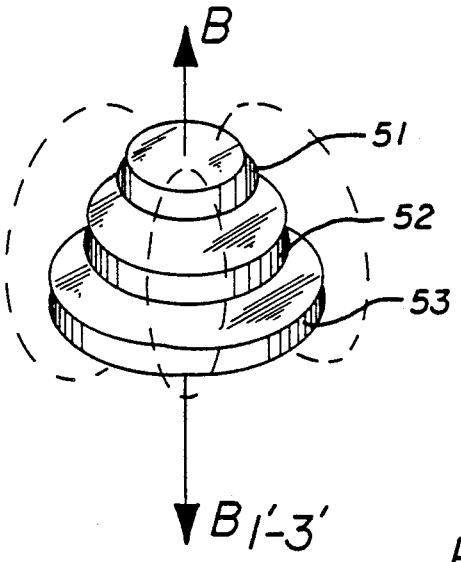
FIG. 9 is a like view showing another configuration of the permanent magnets of the invention, in an array.

Another type of feature, however, is the external size or configuration of the magnets themselves. Thus as suggested in FIG. 9 the magnets 51, 52, 53 may be different sizes. Here a "correct" array may be defined as one in which the magnets are arranged in order by size, or in a *particular* order by size—e.g., the smallest magnet 51 at the top and the largest 53 at the bottom as shown.

Figure 10:
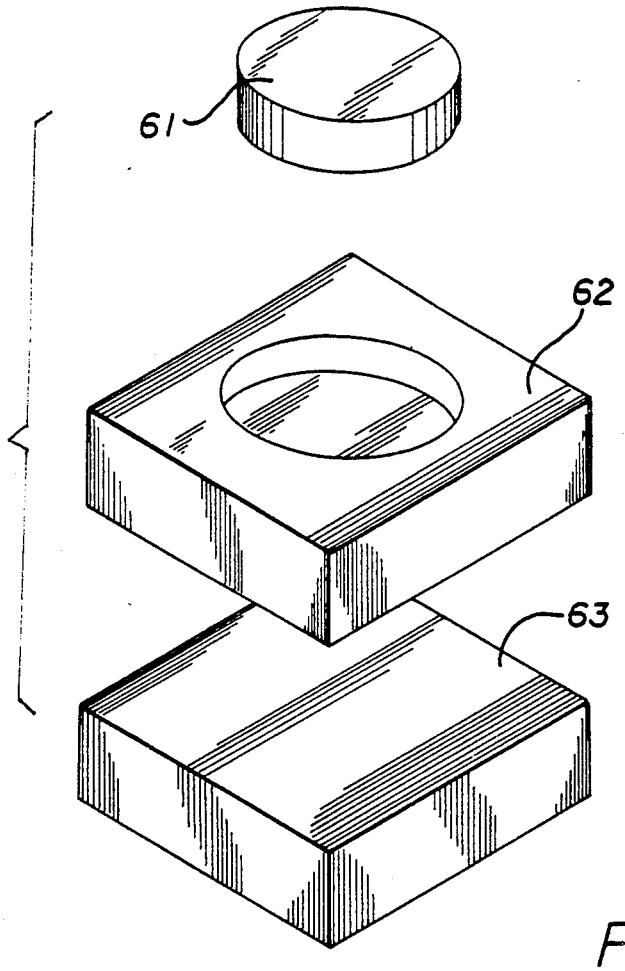
FIG. 10 is a perspective view showing another configuration of the permanent magnets of my invention, not yet assembled into an array.
Figure 11:
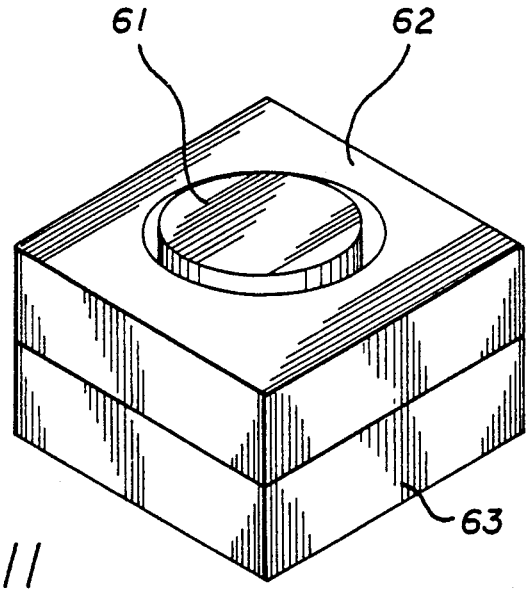
FIG. 11 is a like view showing the FIG. 10 magnets in an array.

This type of feature may be further elaborated as in FIGS. 10 and 11, in which the pieces have different shapes that fit within or upon one another in clearly distinct ways. Here one small cylindrical magnet 61 (FIG. 10) fits into a small cylindrical hole in an otherwise generally square magnet 62, and these two together are to be arrayed above another generally square magnet 63 that has no hole—forming the array shown in FIG. 11. Myriad other possibilities will be suggested by these basic examples.

Figure 12:
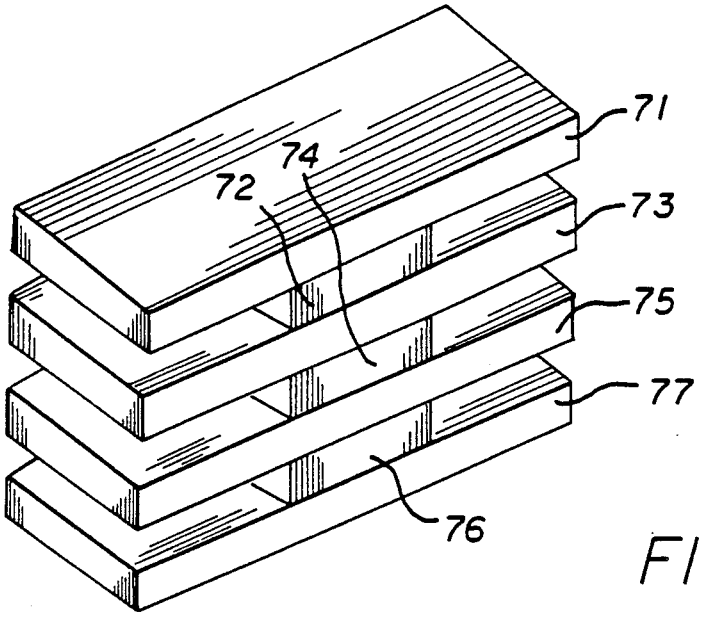
FIG. 12 is a like view showing yet another configuration of the permanent magnets of the invention, in an array.

Still another type of feature is illustrated in FIG. 12. The magnets here are of two different shapes, some magnets 72, 74, 76 being generally square and other magnets 71, 73, 75, 77 being generally rectangular. In the "correct" array the two configurations alternate, the square magnets are neatly centered along the rectangular magnets, and the rectangular magnets are all aligned in parallel.

Figure 13:
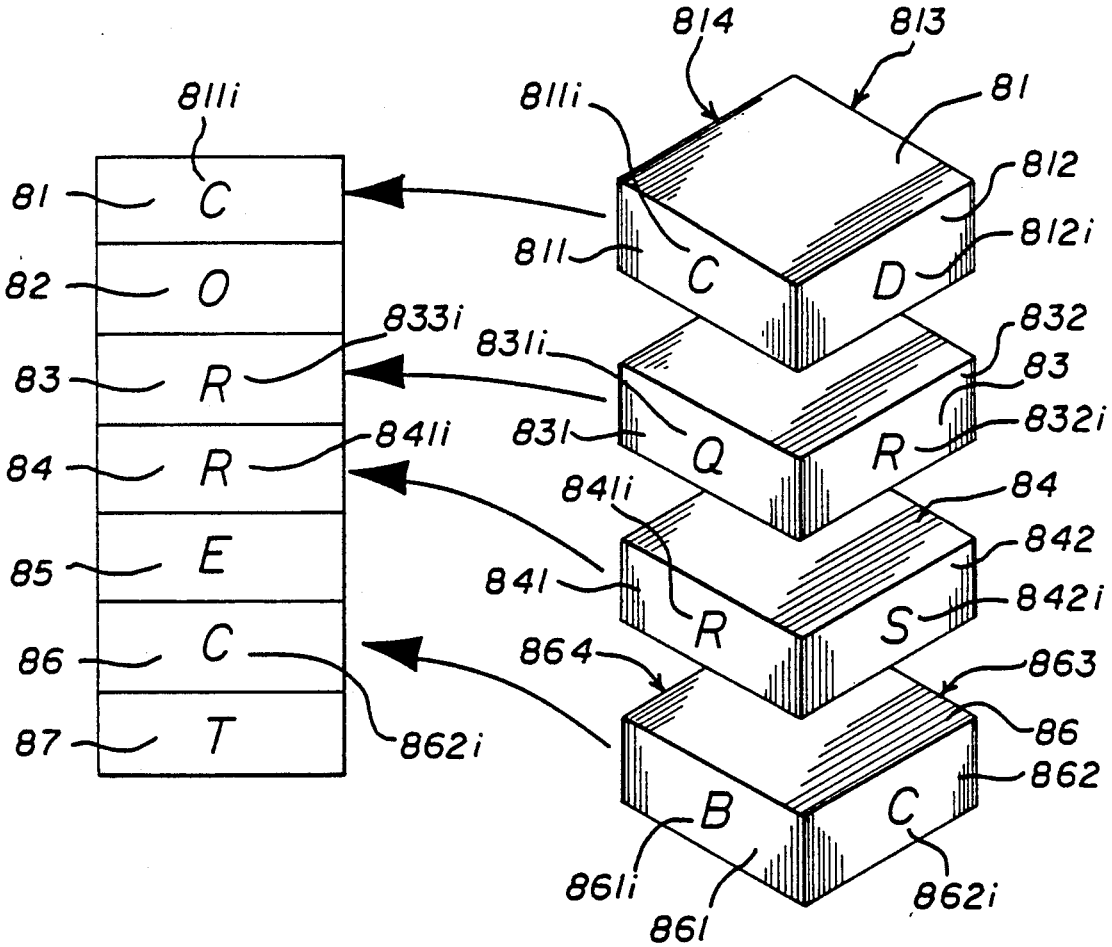
FIG. 13 is a composite view, partly in elevation and partly in perspective, showing still another configuration of the permanent magnets of my invention. The elevation shows the magnets in an array, and the perspective view shows some of the same magnets individually.

Another suggestion (and it must be understood that these suggestions are neither exhaustive nor meant to be exhaustive) of different features appears in FIG. 13. The magnet shapes have some two-dimensional symmetry—here square, but only by way of example—so that they can be stacked in a neat array in a number of different rotational orientations. As will be apparent, the feature being described here could be used even with cylindrical magnets.

Indicia on the edges (or edge, for a cylinder) of each magnet, however, render these different orientations distinct from one another. If desired, the number of indicia may equal the number of facets on one magnet—for example, in a variant of the arrangement in FIG. 13, four colors could be used as indicia—and they may be in the same sequence about the periphery of all the magnets. Thus in a "correct" array a different color stripe would run down each facet of the entire array.

On the other hand, a great many more indicia may be employed than the number of facets on one magnet. FIG. 13 shows letters of the alphabet used as indicia, and as will be clear the letters may be in a consistent and logical or familiar sequence around each magnet where they appear (this is the scheme suggested in FIG. 13), or they may be applied inconsistently and more arbitrarily.

In FIG. 13 the letters appear in alphabetical order from left to right (which is to say, counterclockwise as viewed from above) around each magnet. Thus magnet 86 near the bottom of the array bears on its left near face 861 an indicium 861*i* consisting of the letter "B", followed on the right near face 862 by an indicium 862*i* consisting of the letter "C". An identical magnet 81 at the top of the array is shown rotated so that the "C" is visible as an indicium 811*i* on the left near face 811, and another indicium 812*i* consisting of a letter "D" appears on the right near face 812.

The indicia on the far faces of these two magnets, not visible in FIG. 13, thus include a like letter "D" on the right far face 863 of the lower magnet 86; and a like letter "B" on the left far face 814 of the top magnet 81. In addition, it will be understood that an indicium consisting of the letter "A" appears on the left far face 864 of lower magnet 86 and the right far face 813 of top magnet 81.

A similar literal sequence "P" through "S" appears on the third and fourth (counting from the top of the array) magnets 83 and 84. Other magnets 82, 85, 87, etc. carry other combinations of letters.

For purposes of the game, the array may be defined as correct when the letters all spell a word—or, if preferred, a word in some particular class of words, or some particular one word. Alternatively, the array may be defined as correct only if the letters do *not* spell any word, on any of the faces of the array.

The elaborations just described enhance the enjoyment of my game by introducing various rudimentary requirements for strategy in play. That is, before beginning to form an array a player must rearrange the magnets on the playing surface so that the resulting array will be correct.

Other rearrangements may be desirable to make the formation of an array more efficient—and thereby to reduce the overall time required to form the array. Hence even in the forms of my invention already described there is a significant element of strategy, and this element may be crucial to retaining the interest and attention of adult players on a longterm basis and for many repeated sessions of play.

The element of strategy can be even further augmented by imposing upon the pieces at the beginning of play a standard starting arrangement that is, for example, particularly inefficient for formation of an array. Numerous such starting arrangements can be devised, and presented (in order of increasing difficulty, for example) in an instruction book for use by players in successive sessions of play; or randomly occurring starting arrangements may be used instead.

Figure 14:
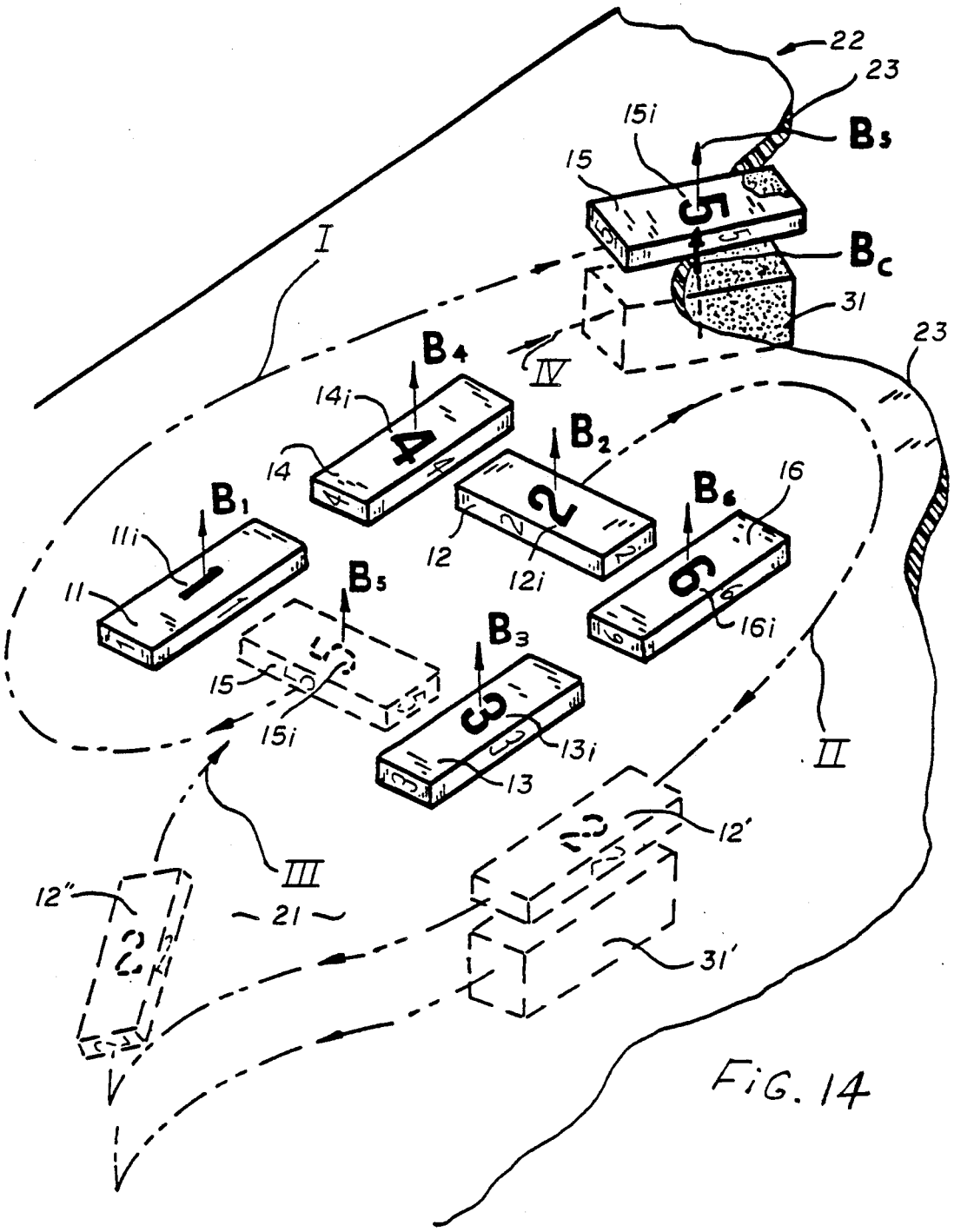
FIG. 14 is a perspective view similar to FIG. 1, but showing the permanent magnets in one preferred starting pattern on the playing surface; and also illustrating some aspects of the game method.

One starting arrangement that is of moderate-to-high difficulty appears in FIG. 14. The magnet 15 that carries indicium "5", for best efficiency of forming a numerical-order array such as that in FIG. 8, should be between and parallel to the magnets 14 and 16 that respectively carry the indicia "4" and "6"— as in FIGS. 1 and 2. Similarly the magnet 12 that carries the indicium "2" should be between and parallel to the magnets 11 and 13 that carry the indicia "1" and "3"— as in FIG. 1.

In the starting arrangement of FIG. 14, however, the magnet 15 carrying indicium "5" is perpendicular to the magnets 14 and 16 carrying indicia "4" and "6", and also is not between those two magnets. Furthermore it is blocked from that desirable position by the magnet 12 carrying indicia "2". In fact, these two mispositioned magnets 15 and 12 are mutually blocking.

The dashed arrows I through IV in FIG. 14 represent one useful strategic prearrangement of the magnets to make array formation efficient. As shown, the manipulator 31 is placed below the playing-surface panel 22, with its field vector $B_c$ oriented in common with those of the magnets 11–16 on the surface 21. The manipulator accordingly attracts the individual magnets and can be used to slide them along the surface.

In the illustrated strategy, the magnet 15 that carries the indicium "5" is first moved to its position shown in solid lines at the upper right in the drawing. The magnet 15 is moved to this location along path I from its starting position 15', where the magnet is drawn in broken lines. In the process, once reasonably clear of the fields of the other magnets on the surface 21, the magnet 15 that is being shifted can also be rotated into parallelism with the four mutually parallel magnets 11, 13, 14, 16—with little danger of disrupting the regularity of their parallel pattern.

Next the magnet 12 that carries the indicium "2" is moved along the path II—which is complementary or symmetrical to path I discuseed above—to an intermediate position 12', shown in broken lines (together with the manipulator at a corresponding intermediate position 31'). Here the magnet 12 being shifted is already rotated into parallelism with the four unshifted magnets 11, 13, 14, 16.

The magnet 12 being shifted continues through this intermediate position 12' to a second intermediate position 12'', also drawn in broken lines. At this point, both of the two shifted magnets 12 and 15 are at the opposite ends of the starting pattern from their initial positions, and aligned parallel with the unshifted magnets 11, 13, 14, 16.

It remains only to move the two shifted magnets lengthwise into place between the unshifted magnets. The magnet 12 carrying the indicium "2" proceeds along the path III into generally the position previously occupied by the other shifted magnet 15 carrying the indicium "5". The latter 15 moves complementarily along the path IV into generally the position previously occupied by the former 12. As already noted, however, both are already rotated on the playing surface 21 to orientations that are generally perpendicular to their initial orientations.

After a player has completed a turn—that is, after a player has completed an array that is as close to the correct pattern as that player can produce—the degree of correctness and the length of time required for that player can be recorded, and if desired scored. If desired the starting layout of FIG. 14 can then be reestablished, and another player can take a turn using that starting layout.

This protocol for playing my game has the advantage that all of the players can focus their attention on the efforts of one player at a time—and thereby develop a full enjoyment of that player's skills and foibles alike. This protocol thus advantageously maximizes interaction between the players. On the other hand, this protocol has the disadvantage that the players taking later turns may be able to benefit unfairly from observing and assessing the rearrangement strategies of the players taking earlier turns.

If preferred, therefore, a starting layout such as that of FIG. 14 can instead be replicated for as many players as desired. The identical layout of FIG. 14 can be established at, for example, four player positions about a playing panel. Play for all of the competitors can then proceed concurrently—giving each player an equal chance to develop winning strategy without giving away ideas to other players.

Figure 15:
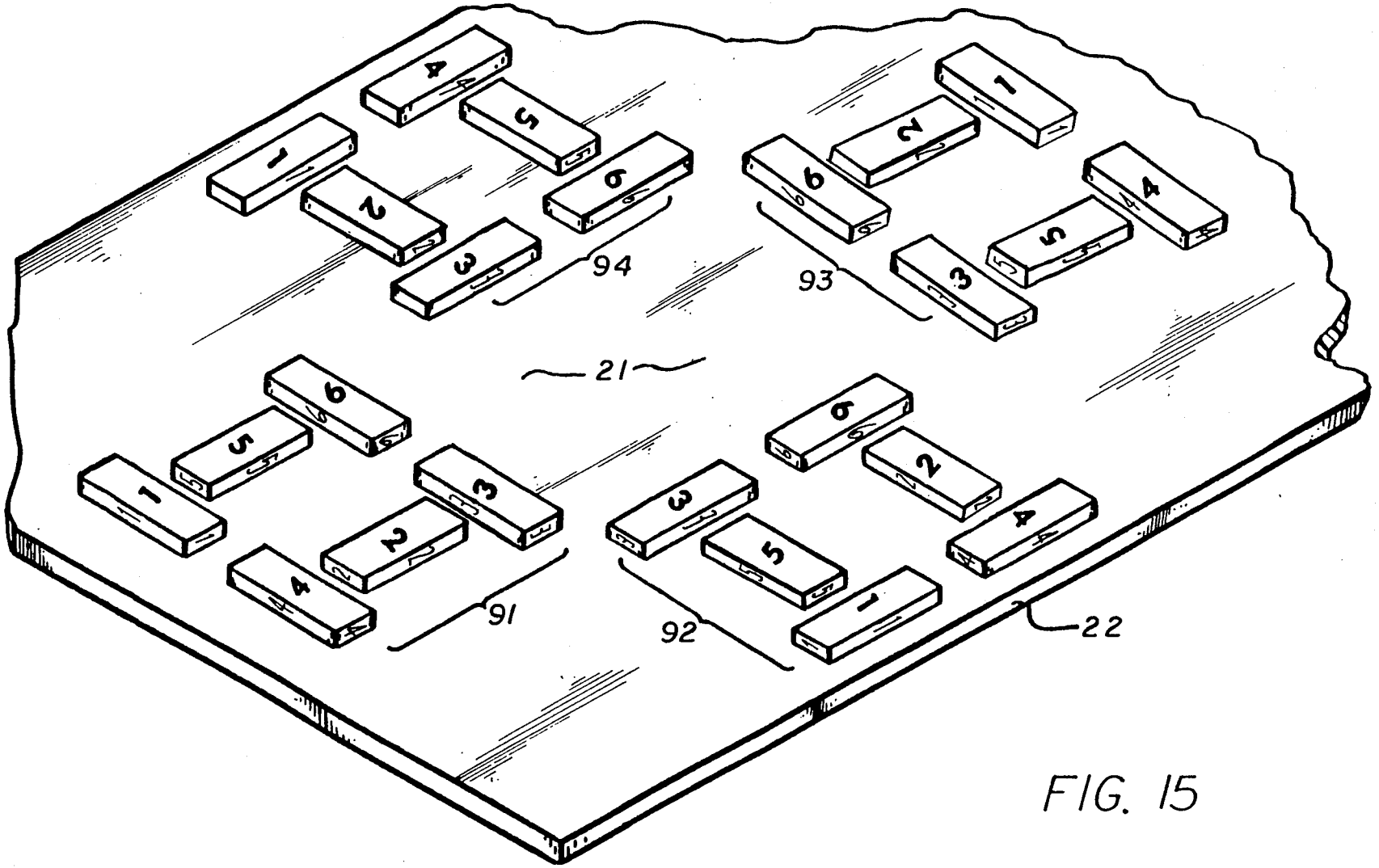
FIG. 15 is a perspective view showing the playing surface prepared for play by four players, with the magnets in patterns related to the FIG. 14 starting pattern.

Yet another possible protocol for play is illustrated in FIG. 15. In four starting layouts 91–94, the gross geometric patterns are identical but the positions of the individual magnets as identified by their indicia are different.

Thus layout 92 is very similar to the starting layout of FIG. 14, but reversed. That is, the magnets with the lower-value indicia "1" and "4" here are to the right of the magnets with the high-value indicia "3" and "6" respectively; whereas in FIG. 14 they are to the left.

Layout 91 is another variant, the magnet with the indicium "1" being in the same row with the magnets carrying indicia "6" and "2"; and the magnet with the indicium "4" being in the same row with the magnets bearing indicia "3" and "5". The opposite associations are seen in FIG. 14. Layouts 93 and 94 similarly are other variants of the three arrangements already discussed.

Now it will be understood that play can proceed either sequentially or concurrently for all the players, as preferred. Even if each player taking a later turn can watch the strategy of each player taking an earlier turn, the natural resulting advantage is negated to some extent through the confusion introduced by the above-described differences between the starting layouts.

As mentioned earlier, the macroscopic magnets of my invention are of a different order than some miniature or near-microscopic flakes or cylinders used in earlier magnetic toys. Thus, for example, the magnets of my invention are typically between three-quarters inch and two inches across. (This range applies to the shorter dimension, for magnets that are not symmetrical in plan.) The magnets typically are between one-eighth inch and three-quarters inch tall. As will be understood, considerably larger magnets can be used.

As also indicated earlier, suitable scoring or arrangements for selection of a winning player may significantly enhance the overall appeal of my invention. I prefer to define the "winner" as a player who obtains the best result—that is, creates a pack or packs with the most nearly correct pattern—in the shortest time.

Advantageously, separate scoring patterns are established for the degree of accuracy of an array, and for the length of time used. Purely by way of example, each player may receive one hundred points at the outset of the game; and may lose fifteen points for each magnet that is out of correct sequence, and may also lose five points for each magnet that is out of correct orientation.

Further, the player who finishes in the shortest time may gain twenty-five points, while the player who finishes in the longest time may lose twenty-five points. If more than four players are participating, the players who finish in the second-shortest and second-longest times may respectively gain and lose ten points each.

A player whose overall score exceeds one hundred points may be termed an "expert" player, and may be called upon in subsequent rounds of play to suffer a handicap—e.g., may be required to work with a larger pack of magnets or to begin from a starting arrangement of greater difficulty. On the other hand, a player whose overall score is negative may be termed a "novice" or "apprentice" player, and in subsequent rounds of play may be accorded certain benefits—such as, for example, using a particular group of magnets that is easier to form into arrays.

The playing surface 21 and the panel 22 that defines it are advantageously of a material that has magnetic permeability close to unity: glass, plastic, etc. During play the distance of the manipulator 31 below the panel 22 is strategically variable by the player: typically closer to the panel when the array is already large, to produce greater force for jumping another magnet onto the tall array; and typically further from the panel when the array is just being begun, to moderate the force.

Advantageously, to provide still further variants of my invention and thereby further sustain the attention of players, the value of the magnetic field of the manipulator can be made variable. For this purpose different manipulators can be available for selection by each player, or instead a single manipulator can be made to supply a great variety of different field shapes and strengths.

Figure 16:
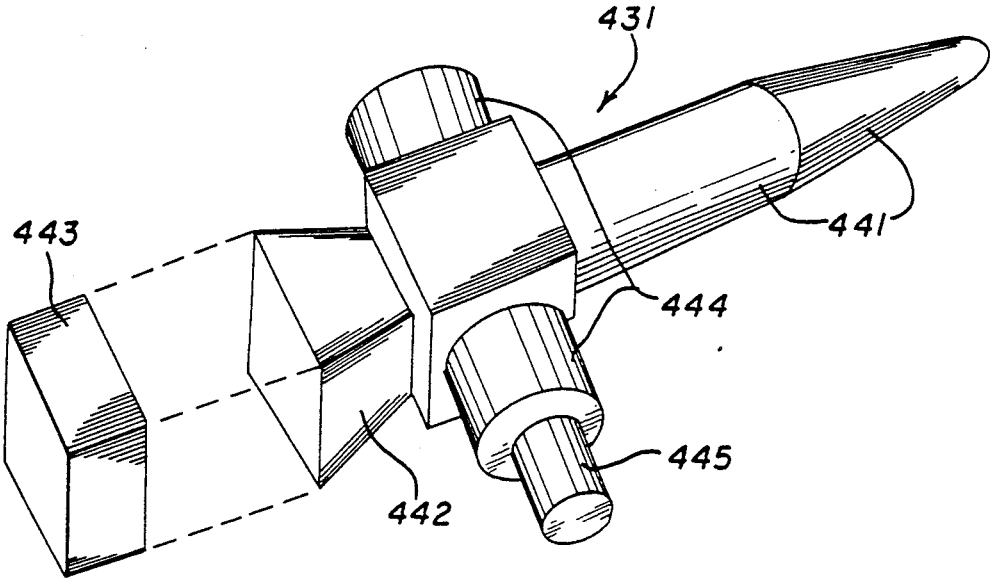
FIG. 16 is a perspective view of a preferred form of manipulator for use in any of the embodiments of my invention discussed in this document.

For example, as shown in FIG. 16, a single manipulator 431 may have plural or multiple operative lobes or other components 441, 442, 444. A player selects the desired lobe or other component for use by turning the manipulator so that the desired lobe or component is closest to the underside of the playing-surface panel 22.

Further, one component 444 (or more, if preferred) of the manipulator 431 may itself be adjustable in field strength or shape as by provision of a movable core 445 that is manually adjustable within the particular component 444. Instead, or in addition, a player can control field strength or shape by fitting an additional magnetic piece 443 over a permanent lobe 442, or omitting this additional piece 443, as preferred.

Yet another way of varying the field strength is to provide the manipulator in the form of an electromagnet, whose current can be switched on and off, or varied, at will. In effect the field strength is remote controlled.

Figure 17:
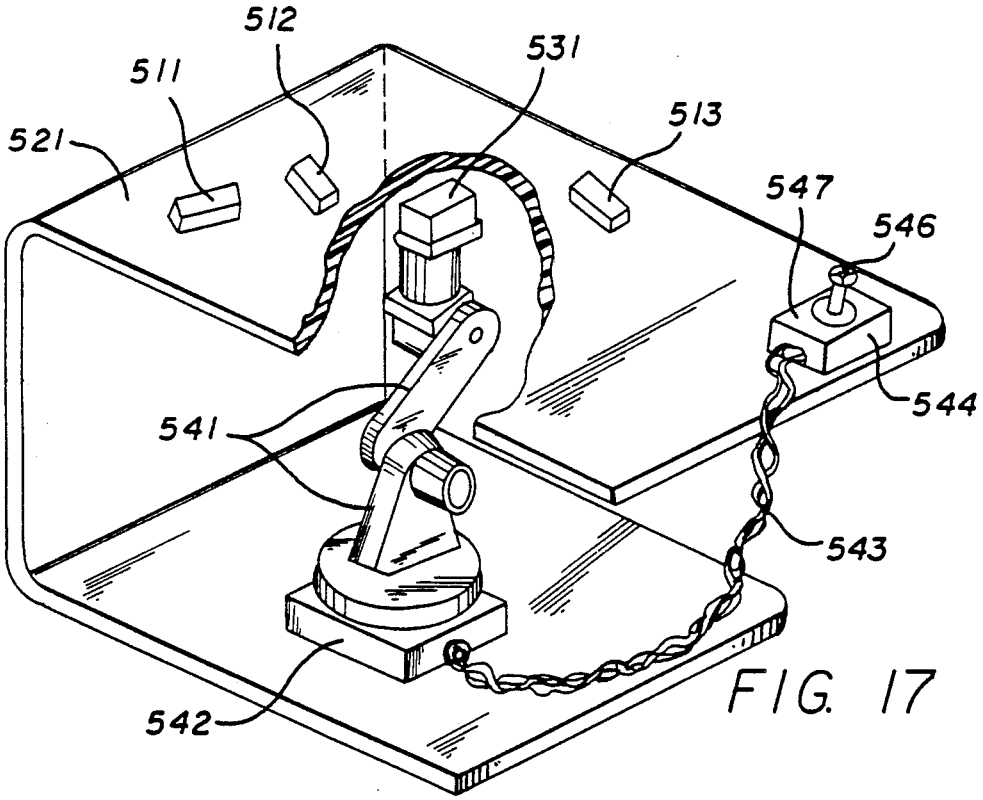
FIG. 17 is a perspective view of a remote-controlled manipulator, also showing electrical-current control for use when the manipulator is an electromagnet.

Further, not only the strength but the position of the magnetic manipulator can be remote controlled, within the scope of my invention. FIG. 17 thus illustrates a playing surface 521—which is drawn partially cut away for a clearer view of components below—with typical magnets 511–513 on the surface and a remote-controlled apparatus below for positioning and orienting the manipulator 531.

Below the playing surface 521, the manipulator is supported by an articulated robot arm 541, operated by motors from a mechanical base and control module 542. This module 542 is in turn controlled by electrical signals in leads 543 from a manually operated remote-control unit 544. The latter advantageously takes the form of a joystick with the familiar control paddle 546.

If the manipulator 531 is an electromagnet as mentioned above, the remote-control unit 544 preferably includes an electrical switch or continuous controller 547 for adjusting or interrupting the current to the electromagnet. As will be understood, any of the other forms of manipulator discussed or shown earlier can be provided as an electromagnet, together with such current control as illustrated here—even when there is no joystick or other remote control of manipulator position or orientation.

If the manipulator 31, 531, etc., is a permanent magnet, it can be either specially manufactured to be distinctive from the individual magnets 11–16, 511–513, etc., or simply assembled from a number of the individual magnets placed together in a pack or array. The strength of the manipulator can be changed by changing the number of individual magnets in such a pack. In addition to economy of manufacture, the stacked-magnet alternative offers extensive variations in skill level and scoring elaborations, without any added hardware complexity.

In any event, when the individual magnets 11–16, 511–513, etc. are not in use, I prefer to assemble them (ideally together with the carrier) as a pack. This is the condition in which they are when the game is completed, and I prefer to keep them in this condition. This procedure is beneficial not only to the useful lives of the individual magnets but also for keeping the pieces properly oriented—that is, with all their magnetic-field vectors commonly oriented, for convenient placement onto the playing surface at the start of the next game.

It will be understood that the foregoing disclosure is intended to be merely exemplary, and not to limit the scope of the invention—which is to be determined by reference to the appended claims.

I claim:

1. Game apparatus for use by a player and comprising:

a base defining a substantially continuous playing surface;

macroscopic permanent magnets supported directly and generally free to slide about on the substantially continuous playing surface, each magnet having a magnetic field vector that is substantially perpendicular to the surface where that magnet is supported;

the magnets having their respective field vectors oriented in common relative to the surface where, respectively, the magnets are supported; and a magnetic manipulator disposed below the surface, and generally below a first particular individual one of the magnets, and controlled by such player to cause said first particular one magnet individually to form a predetermined regular array, generally wherever on the substantially continuous playing surface the player chooses, with at least one other particular individual one of the magnets;

the field-vector orientation of each permanent magnet being the same after formation of the array as before.

2. The game apparatus of claim 1, wherein:

the magnetic field of the manipulator during formation of the array is constantly present and of constant strength, and interacts with the magnetic fields of the magnets to apply exclusively magnetic force or torque, or both, to the first particular individual one magnet or to the first particular individual one magnet, or to both; and the manipulator, during forming of the array, is controlled as to orientation exclusively.

3. The game apparatus of claim 1, wherein:

the manipulator has a magnetic field vector that is generally parallel, but oriented substantially in opposition, to the magnetic-field vector of said first particular individual one magnet;

whereby the manipulator repels said first magnet above said other magnet to form the array.

4. The game apparatus of claim 1, wherein:

the manipulator geometry is effectively variable.

5. The game apparatus of claim 4, wherein:

the manipulator has a plurality of distinctly different magnetic-field configurations that are selectable by such player.

6. The game apparatus of claim 5, wherein:

the manipulator comprises a plurality of discrete structures with respective distinctly different magnetic-field configurations that are selectable through reorientation of the manipulator by such player.

7. The game apparatus of claim 5, wherein:

the manipulator comprises an adjustable magnetic element.

8. The game apparatus of claim 7, wherein:

the manipulator comprises an electromagnet; and the adjustable magnetic element comprises an electromagnet core that is manually movable relative to the electromagnet.

9. The game apparatus of claim 1, wherein:

the array comprises a multiplicity of the macroscopic permanent magnets; and the array inherently possesses a definite predetermined correct geometric relationship between all of the magnets;

wherein, during use of the game apparatus, such player obtains a score that is independent of position of the array on the playing surface; and that depends at least in part upon the time required to form the array, or the degree of accuracy of the array with respect to said predetermined correct relationship, or both.

10. The game apparatus of claim 9, wherein:

the individual magnets are distinctly different from one another in configuration; and the definite predetermined correct geometric relationship of the array is defined at least partly in terms of distinct differences in configuration of the individual magnets.

11. The game apparatus of claim 9, wherein:

the individual magnets are substantially similar to one another in configuration, but bear distinctly different indicia; and the definite predetermined correct geometric relationship of the array is defined at least partly in terms of distinct differences among the indicia.

12. The game apparatus of claim 9, wherein:

each individual magnet comprises means for rendering distinctive the rotational orientation of that magnet about a vertical axis; and the definite predetermined correct geometric relationship of the array is defined at least partly in terms of relationships between the respective rotational orientations of the magnets in the array.

13. The game apparatus of claim 12, wherein:

the orientation-rendering means of each magnet comprise a rotationally asymmetric configuration of that magnet.

14. The game apparatus of claim 12, wherein:

the orientation-rendering means of each magnet comprise indicia carried on that magnet.

15. The game apparatus of claim 1, further comprising:

mounted to each one of at least some of the permanent magnets, an associated sensor and indicator for indicating conditions related to the progress of the game;

wherein each sensor is sensitive to conditions including:

the height of an array containing the associated magnet, or a portion of the height of an array containing the associated magnet that is above the associated magnet, or the position of the associated magnet in an array containing the associated magnet, or combinations of these enumerated conditions.

16. The game apparatus of claim 15, wherein:

the sensor is responsive to magnetic induction and therefore to said conditions.

17. The game apparatus of claim 15, wherein:

the sensor is responsive to pressure and therefore to said conditions.

18. The game apparatus of claim 15, wherein:

the indicator produces a visible indication of such events.

19. The game apparatus of claim 15, wherein:

the indicator produces an audible indication of such events.

20. The game apparatus of claim 15, further comprising:

mounted to each one of said at least some permanent magnets, a battery connected to power the associated sensor or indicator or both.

21. The game apparatus of claim 15, further comprising:

mounted to each one of said at least some permanent magnets, an electrooptical device for generating electricity when illuminated;

each said electrooptical device being connected to power the associated sensor or indicator or both.

22. Game apparatus for use by a player and comprising:

a base defining a playing surface;

macroscopic permanent magnets supported directly on the playing surface, each magnet having a magnetic field vector that is substantially perpendicular to the surface where that magnet is supported;

the magnets having their respective field vectors oriented in common relative to the surface where, respectively, the magnets are supported; and a magnetic manipulator disposed below the surface, and generally below a first particular individual one of the magnets, and controlled by such player to cause said first particular one magnet individually to form a predetermined regular array with at least one other particular individual one of the magnets; and wherein:

the magnetic field vector of the manipulator is oriented substantially in common with the magnetic field vectors of the permanent magnets, and levitates said other magnet above said first magnet to form the array.

23. The game apparatus of claim 22, wherein:

the magnetic field of the manipulator is oriented at an angle to the magnetic field vector of said first magnet, and interacts with magnetic field vectors of said first and other magnets to develop a magnetic-wedge effect that raises a nearer edge of said other magnet.

24. The game apparatus of claim 23, wherein:

the manipulator holds one magnet in place against the surface while pulling the other magnet against the magnetic repulsion of said one magnet.

25. (to follow claim 3) The apparatus of claim 22, wherein:

the playing surface is substantially continuous;

the macroscopic permanent magnets are generally free to slide about on the substantially continuous playing surface; and the manipulator is controlled to form said array generally wherever on the substantially continuous playing surface the player chooses.

26. A method for playing a game, comprising the steps of:

first positioning macroscopic permanent magnets directly on a substantially continuous playing surface where the magnets are generally free to slide about, with the magnetic-field vector of each magnet substantially perpendicular to the surface where that magnet is positioned; and orienting the magnets so that their respective field vectors are directed in common relative to the surface where, respectively, the magnets are positioned;

then disposing a magnetic manipulator below the playing surface, and generally below a first particular individual one of the magnets; and then controlling the manipulator to cause said first particular one magnet individually to form a predetermined regular array, generally wherever on the substantially continuous surface the player chooses, with at least one other particular individual one of the magnets;

the field-vector orientation of each permanent magnet being the same after formation of the array as before.

27. The method of claim 26, wherein:

the controlling step consists exclusively of orienting and guiding the manipulator so that its magnetic field interacts with the magnetic fields of the magnets to apply exclusively magnetic force or torque, or both, to said first magnet or to said other magnet, or to both; and during the controlling step the magnetic field of the manipulator is constantly present and of constant strength.

28. The method of claim 26, wherein the disposing step comprises:

orienting the manipulator so that its magnetic-field vector is generally parallel, but substantially in opposition, to the magnetic field of said first particular individual one magnet; and while the manipulator is so oriented, using the manipulator to repel said first magnet above said other magnet to form the array.

29. The method of claim 26, wherein:

the controlling step comprises guiding the manipulator by remote control.

30. The method of claim 26, wherein:

the controlling step comprises adjusting electric current in an electromagnet that forms part of the manipulator.

31. The method of claim 26, wherein:

the controlling step comprises effectively varying the manipulator geometry.

32. The method of claim 31, wherein:
the controlling step comprises selecting from a plurality of distinctly different magnetic-field configurations of the manipulator.

33. The method of claim 32, wherein:
the selecting step comprises reorienting the manipulator to bring into effective use less than all of a plurality of discrete magnetic structures of the manipulator, said discrete magnetic structures having respective distinctly different magnetic-field configurations.

34. The method of claim 32, wherein:
the selecting step comprises adjusting a magnetic element of the manipulator.

35. The method of claim 34, wherein:
the adjusting step comprises manually moving an electromagnet core that forms part of the manipulator.

36. The method of claim 26, wherein:
the controlling step comprises guiding the manipulator to attempt to form the array with a particular predetermined geometric relationship between all of the magnets.

37. The method of claim 36, wherein:
the controlling step comprises guiding the manipulator to form the array with a particular predetermined geometric relationship that is defined at least partly in terms of distinct differences in configuration of the individual magnets.

38. The method of claim 36, wherein:
the controlling step comprises guiding the manipulator to form the array with a particular predetermined geometric relationship that is defined at least partly in terms of distinct differences in indicia that are carried on the magnets.

39. The method of claim 36, wherein:
the controlling step comprises guiding the manipulator to form the array with a particular predetermined geometric relationship that is defined at least partly in terms of distinct differences in respective rotational orientations of the magnets in the array.

40. The method of claim 36, wherein:
the positioning-and-orienting step comprises so positioning and orienting a multiplicity of macroscopic permanent magnets on the playing surface; and
the method further comprises repeating the disposing and controlling steps multiple times, but directing said steps to further particular magnets individually rather than to said other magnet, to add said further particular magnets individually to the array in said particular predetermined geometric relationship.

41. (amended) The method of claim 40, wherein:
the particular predetermined relationship has two bottom positions; and has a third position from the bottom, said third position being immediately above the two bottom positions;
in the first performance of the disposing and controlling steps, said first magnet and said other magnet, but not necessarily in that order, are preassociated with the bottom two positions in said particular predetermined geometric relationship; and
in said repeating of the disposing and controlling steps, each repetition is directed to an individual one of said further particular magnets, in a sequence starting with a magnet which is preassociated with the third position from the bottom of said particular predetermined geometric relationship and continuing with the magnets which are above that position, in order.

42. The method of claim 40, comprising the additional step of:
after finally repeating the controlling step, assigning a game score based at least in part upon the degree of conformity of an actual produced array to said predetermined array.

43. The method of claim 40, comprising the additional step of:
after finally repeating the controlling step, assigning a game score based at least in part upon the length of time consumed by all of said disposing and controlling steps.

44. The method of claim 40:
wherein each of a plurality of players performs all of said steps; and
comprising the additional step of, after a final repetition of said controlling step by a final one of said plurality of players, determining a winning player;
the determining step being based at least in part upon the degree of conformity, to said predetermined array, of an array actually produced by each player in a first group of at least two players.

45. The method of claim 40:
wherein each of a plurality of players performs all of said steps; and
comprising the additional step of, after a final repetition of said controlling step by a final one of said plurality of players, determining a winning player;
the determining step being based at least in part upon the length of time used for all of said disposing and controlling steps by each player in a second group of at least two players.

46. The method of claim 40, comprising the additional step of:
later stacking the particular magnets together for storage in at least one group, with the magnetic-field vectors of all the particular magnets in each group directed in common.

47. The method of claim 26, wherein:
the positioning-and-orienting step comprises so positioning and orienting a multiplicity of macroscopic permanent magnets on the playing surface; and
the method further comprises repeating the disposing and controlling steps multiple times to add further particular magnets individually to the array.

48. The method of claim 47:
wherein the positioning-and-orienting step comprises arranging the permanent magnets in an initial pattern; and
further comprising the step of, before first performing the controlling step, guiding the manipulator to rearrange the permanent magnets in a different pattern.

49. The method of claim 48, wherein:
the arranging step comprises placing the permanent magnets substantially arbitrarily or randomly.

50. The method of claim 48, further comprising:
before or during the arranging step, selecting an initial pattern to impose a particular corresponding level of difficulty upon said repeated controlling step.

51. A method for playing a game, comprising the steps of:
first positioning macroscopic permanent magnets directly on a playing surface, with the magnetic-field vector of each magnet substantially perpendicular to the surface where that magnet is positioned; and orienting the magnets so that their respective field vectors are directed in common relative to the surface where, respectively, the magnets are positioned;

then disposing a magnetic manipulator below the playing surface, and generally below a first particular individual one of the magnets; and then controlling the manipulator to cause said first particular one magnet individually to form a predetermined regular array with at least one other particular individual one of the magnets; and wherein:

the disposing step comprises positioning the manipulator with the magnetic field vector of the manipulator oriented substantially in common with the magnetic field vectors of the permanent magnets; and the controlling step levitates said other magnet above said first magnet to form the array.

52. The game apparatus of claim 51, wherein:

the disposing step or the controlling step comprises orienting the manipulator so that its magnetic field vector is at an angle to the magnetic field vector of said first magnet;

whereby the magnetic field of the manipulator interacts with magnetic field vectors of said first magnet and said other magnet to develop a magnetic-wedge effect that raises a nearer edge of said other magnet.

53. The method of claim 52, further comprising the step of:

after the positioning-and-orienting step, if the first magnet is not close to the other magnet, moving the first magnet or the other magnet, or both, so that they are close to each other.

54. The method of claim 53, wherein the moving step comprises:

guiding the manipulator close to said first magnet or said other magnet, to develop an effective force between the manipulator and the first magnet; and then guiding the manipulator so that the effective force displaces said first magnet or other magnet close to said other magnet or first magnet respectively.

55. The method of claim 52, wherein:

the disposing step or the controlling step comprises using the manipulator to hold the first magnet in place against the playing surface while pulling the other magnet laterally against the magnetic repulsion of the first magnet.

56. The method of claim 51, wherein:

the playing surface is substantially continuous;

the macroscopic permanent magnets are generally free to slide about on the substantially continuous playing surface; and the manipulator is controlled to form said array generally wherever on the substantially continuous playing surface the player chooses.

* * * * *